US007143626B2

(12) United States Patent
Dole

(10) Patent No.: US 7,143,626 B2
(45) Date of Patent: Dec. 5, 2006

(54) CRIMPING JAW HAVING ENERGY EFFICIENT CRIMPING DIES

(75) Inventor: Douglas R. Dole, Whitehouse Station, NJ (US)

(73) Assignee: Victaulic Company, Easton, PA (US)

( * ) Notice: Subject to any disclaimer, the term of this patent is extended or adjusted under 35 U.S.C. 154(b) by 150 days.

(21) Appl. No.: 10/495,355

(22) PCT Filed: Oct. 24, 2002

(86) PCT No.: PCT/US02/34069

§ 371 (c)(1),
(2), (4) Date: Oct. 18, 2004

(87) PCT Pub. No.: WO03/035301

PCT Pub. Date: May 1, 2003

(65) Prior Publication Data

US 2005/0044924 A1 Mar. 3, 2005

Related U.S. Application Data

(60) Provisional application No. 60/345,502, filed on Oct. 24, 2001.

(51) Int. Cl.
*B21D 39/04* (2006.01)

(52) U.S. Cl. ..... 72/416; 29/237; 29/282; 29/283.5

(58) Field of Classification Search ..... 72/402, 72/416, 126, 409.01, 409.09, 409.18; 29/237, 29/282, 283.5
See application file for complete search history.

(56) References Cited

U.S. PATENT DOCUMENTS 601,230 A 3/1898 Billing
1,619,064 A 3/1927 Ferguson (Continued)

FOREIGN PATENT DOCUMENTS

JP 60-227932 11/1985

OTHER PUBLICATIONS

International Search Report, dated Jan. 28, 2003, PCT/US02/34069.

(Continued)

*Primary Examiner*—Daniel C. Crane
(74) *Attorney, Agent, or Firm*—Abelman, Frayne & Schwab

(57) ABSTRACT

A jaw (39) for crimping a generally cylindrical compression sleeve (34) in a compression coupling is disclosed in, which at least two support members (39, 41) are adapted to support at least two arcuately shaped dies (24) for movement toward and away from each other for compressing the compression sleeve (34) about an inner concentric pipe or tube (36) to an inner arcuate die surface corresponding in shape and dimension to a predetermined outer surface portion of the compression sleeve so as to engage and compress the compression sleeve when positioned thereabout and moved toward each other. The dies (24) each have at least one crimping roller (30) rotatably mounted adjacent the die surface. The crimping roller (30) is adapted to form a crimp on the compression sleeve and the inner member to form a mechanical attachment therebetween. Various combinations of die/roller arrangements are disclosed to encircle and compress a sleeve/pipe combination to form a compression coupling.

40 Claims, 5 Drawing Sheets

U.S. PATENT DOCUMENTS

| | | | | | |
|---|---|---|---|---|---|
| 2,168,631 | A | | 8/1939 | Scott | |
| 2,235,616 | A | | 3/1941 | Ice | |
| 2,337,362 | A | * | 12/1943 | Willinger | 72/121 |
| 3,308,603 | A | * | 3/1967 | Nelson | 53/334 |
| 3,453,831 | A | | 7/1969 | Rusche | |
| 4,288,906 | A | | 9/1981 | Cocks et al. | |
| 4,655,064 | A | * | 4/1987 | Hoback | 72/31.06 |
| 5,824,906 | A | | 10/1998 | Lohmann | |
| 6,044,686 | A | | 4/2000 | Dischler | |
| 6,164,106 | A | | 12/2000 | Nghiem et al. | |
| 6,224,114 | B1 | | 5/2001 | Franzen et al. | |
| 6,241,290 | B1 | | 6/2001 | Foering et al. | |
| 6,260,891 | B1 | | 7/2001 | Foering et al. | |

OTHER PUBLICATIONS

International Preliminary Examination Report, dated Dec. 17, 2003, PCT/US02/34069.

* cited by examiner

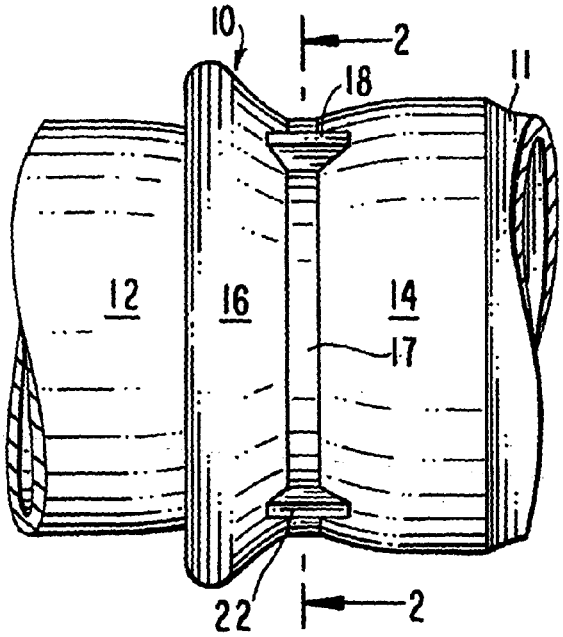
FIG.1
PRIOR ART
FIG.2
PRIOR ART
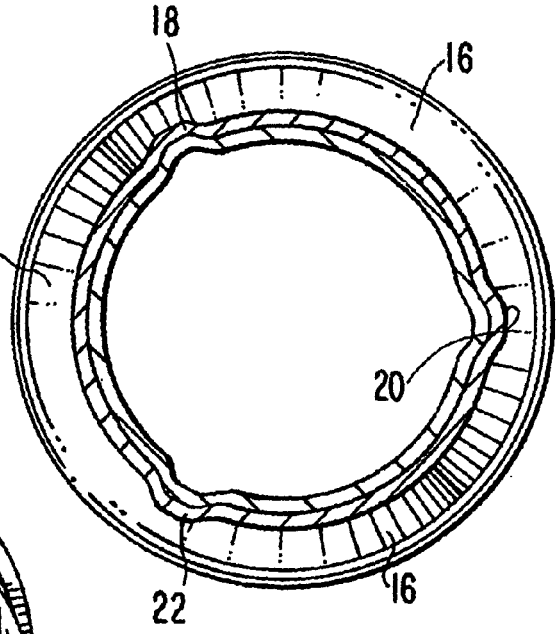
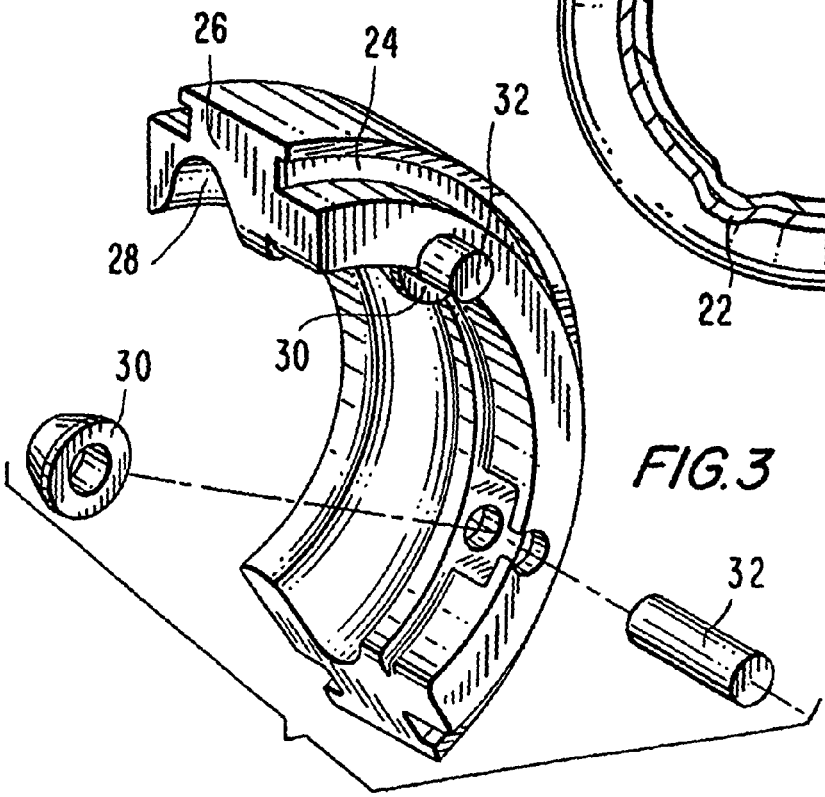
FIG.3

42
41
50
30
6
58
60
56
54
52
62
40
39
48
46
51
44

42
41
24
34
36
32
30
23
50
39
46
44
43
48
40

FIG.6
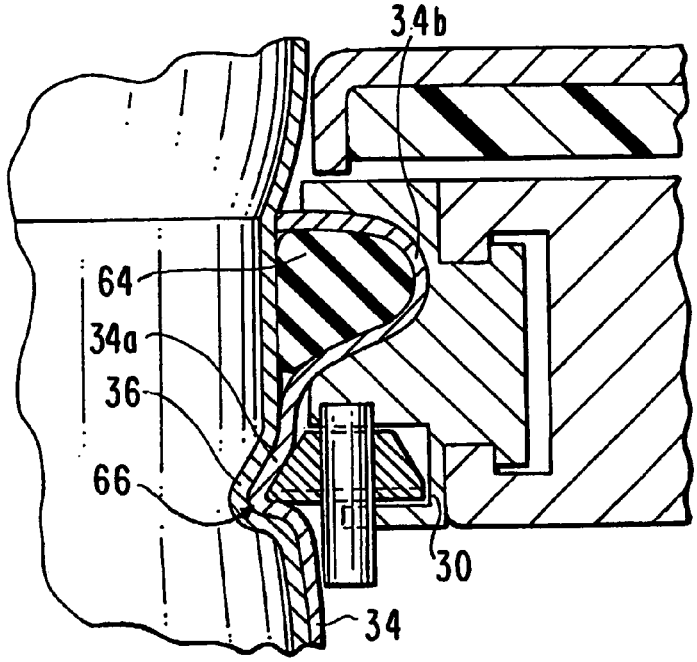
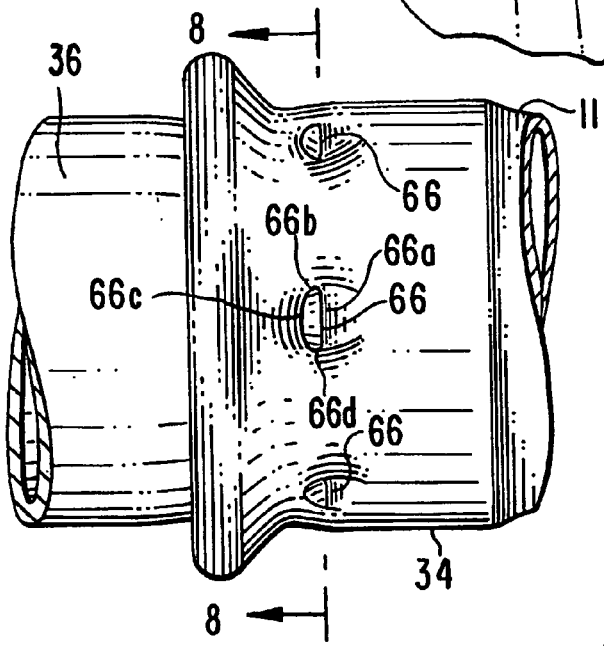
FIG.7
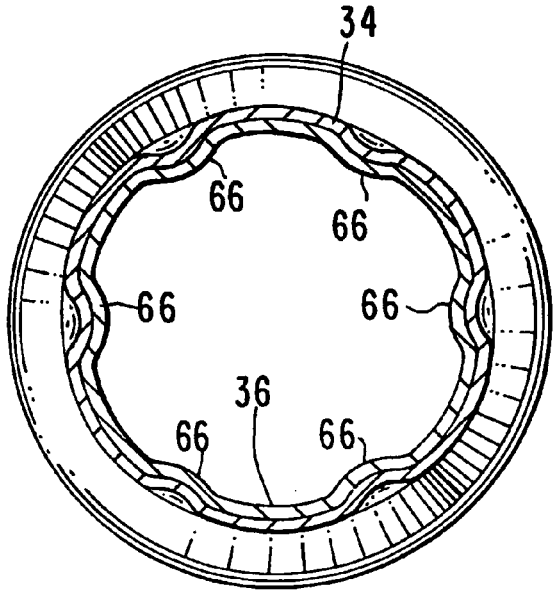
FIG.8

FIG. 9
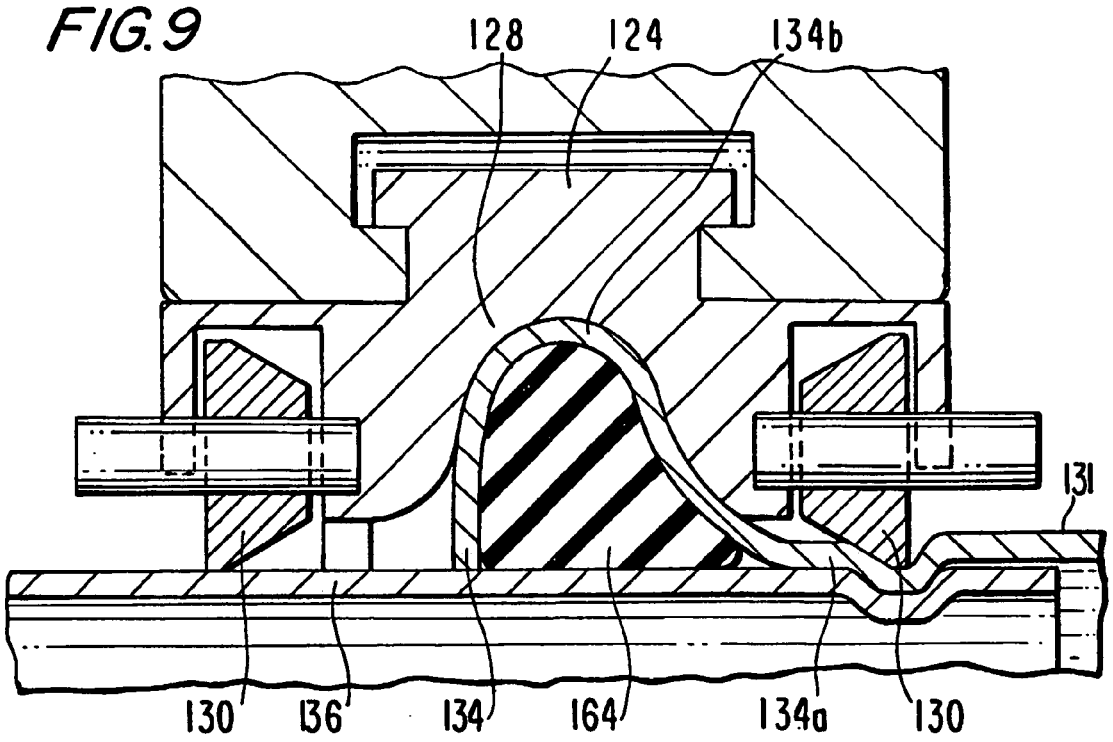
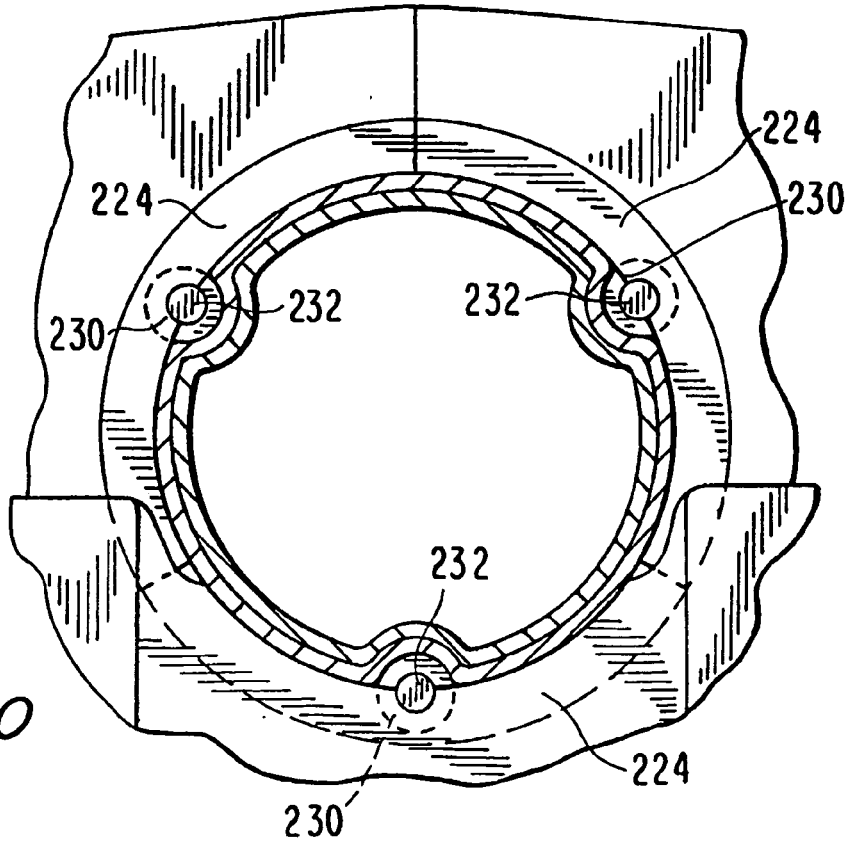
FIG. 10

FIG. 11
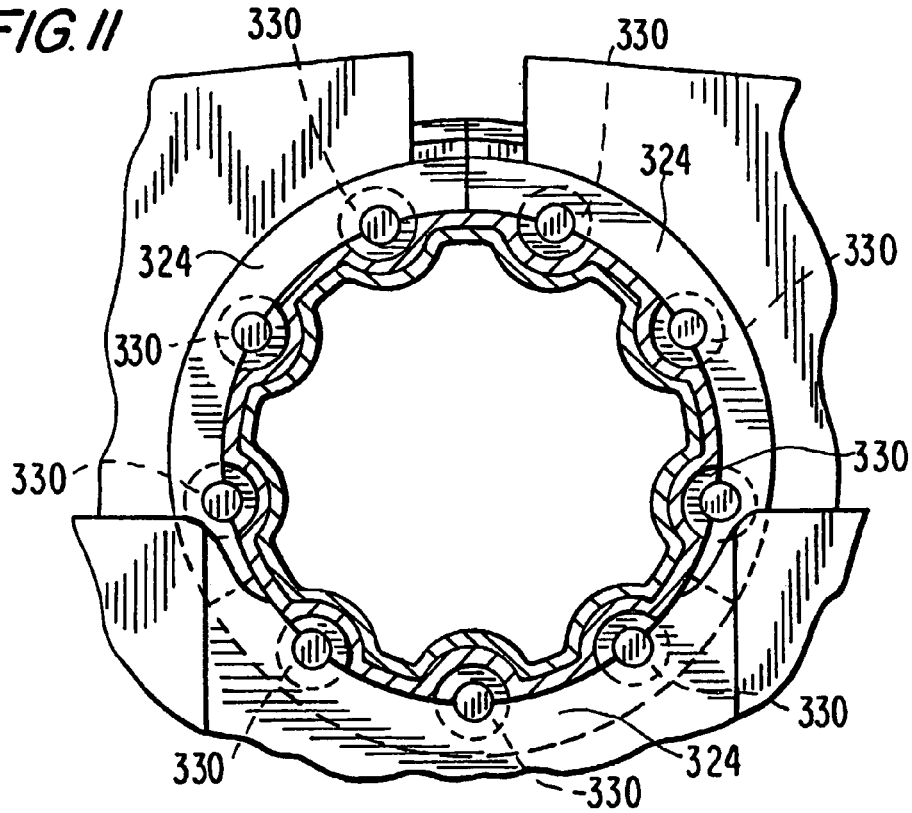
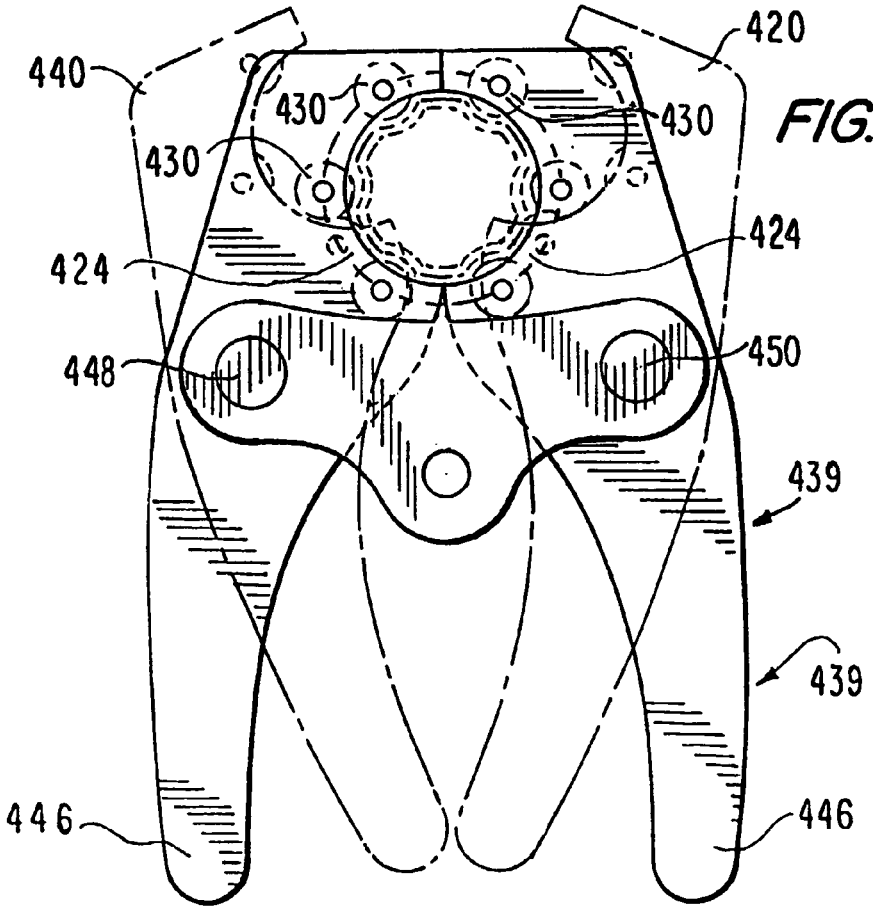
FIG. 12

CRIMPING JAW HAVING ENERGY EFFICIENT CRIMPING DIES

This application is a 371 of PCT/US02/34069, filed Oct. 24, 2002, which claims priority to Provisional Application No. 60/345,502, filed Oct. 24, 2001, the disclosure of which is incorporated herein by reference and made a part of this disclosure.

BACKGROUND OF THE INVENTION

1. Field of the Invention

The present invention relates to crimping jaws of the type used to assemble compression sleeves onto lengths of pipe to form compression couplings, sometimes referred to as compression joints. In particular, the invention relates to energy efficient dies for such jaws for crimping such fittings in an improved manner.

2. Description of the Related Art

A compression coupling comprises a generally tubular compression sleeve (sometimes referred to as a compression fitting) containing an O-ring which is compressed in radial directions in order to engage the compression sleeves with the respective ends of pipes, and in so doing, form a leak resistant joint between the pipe ends. The joint itself has considerable mechanical strength and is self supporting in the absence of ancillary support members.

In the present application "crimping jaw" refers to the actual device which includes crimping dies for forming a compression joint. For example, a common form of crimping jaw is disclosed in commonly assigned U.S. Pat. No. 5,611,236 to Grunwald, which includes a pliers-type device having crimping dies attached thereto for crimping compression sleeves. This pliers-type device is generally operated with a power tool which spreads the free ends of the plier arms to squeeze the jaws about the sleeve/pipe combination to form a compression joint. Other devices known to persons skilled in the art such as "non-plier" type jaws are also contemplated for use with the present dies.

In order to form a successful compression joint with a crimping jaw using a compression sleeve, one of the major considerations is that the crimping jaw shall not scuff, cut, scrape or gouge the compression sleeve during the crimping operation.

Further, as noted in the Grunwald '236 patent, it is essential that the crimping dies of the jaw approach each other in end-to-end parallelism. If the dies do not engage each other in end-to-end parallelism, then, there is a probability of pinching and cutting of the compression sleeve at certain points around the circumference thereof, while other points on the circumference of the compression sleeve are not fully compressed. In known jaws such pinching and "bunching-up" of compression sleeve material has been known to occur at the interfaces of the dies. This condition can result in a faulty joint, in that a blow-out and leakage can occur at the damaged portion of the compression sleeve when the pipe line is subjected to pressure, and, in the alternative, leakage axially of the pipe can occur at the insufficiently compressed portions of the compression sleeve.

Crimping jaws used for assembling compression sleeves with pipes or tubes are required to include crimping dies that can move radially and somewhat circumferentially with respect to the central longitudinal axis of the compression sleeve. A simple pliers-type crimping jaw cannot successfully accomplish precisely the desired movements because the dies of the pliers each move on an arcuate path. In such instance, the result is that considerably more force is exerted on the compression sleeve on its radius closest to the pivot axis of the pliers, causing the sleeve to shift within the jaw, with the potential danger of cutting the compression sleeve. At the same time the compressive force which is exerted at the diametrically opposite radius would be lesser and insufficient. Furthermore, substantial losses of crimping energy are encountered due to the friction forces developed between the dies and the sleeve, and particularly at each interface between the dies wherein the outer surface material of the sleeve tends to "bunch-up" and form raised portions on the periphery of the sleeve.

I have invented a crimping die for such compression jaws which significantly reduces the friction developed between the dies and the compression sleeve by the provision of unique rollers on the dies, which produce limited, but sufficient crimps on the sleeve/pipe combination, while providing a much improved sleeve/pipe attachment and utilizing less-crimping energy, and force. In particular, the present invention applies less force to produce an improved attachment with less utilization of energy.

SUMMARY OF THE INVENTION

The invention relates to a jaw for crimping a generally cylindrical compression sleeve in a compression coupling, which comprises at least two support members adapted to support at least two arcuately shaped dies for movement toward and away from each other for compressing the workpieces in the form of a compression sleeve about an inner member to form a sealed coupling therewith. Each die has an inner arcuate die surface corresponding in shape and dimension to a predetermined outer surface portion of the compression sleeve so as to engage and compress the compression sleeve when positioned thereabout and moved toward each other. The dies each have at least one crimping roller rotatably mounted adjacent the die surface. The crimping roller is adapted to form a crimp on the compression sleeve and the inner member to form a mechanical attachment.

In a preferred embodiment the radially innermost dimension of the crimping roller as measured relative to a central longitudinal axis of the compression sleeve is less than the corresponding radius of the die surface such that when the dies are positioned about the compression sleeve and forcibly moved toward each other to engage and compress the compression sleeve, the rollers engage and crimp portions of the compression sleeve to form the mechanical attachment. The compression sleeve has a generally tubular configuration and includes a section having an arcuate concave cross-section for reception of an elastomeric O-ring therewithin, and each die has an arcuately shaped die surface corresponding in dimension and shape to be positioned about the compression sleeve for applying compression thereto and to the O-ring to form a sealed attachment.

Each die has at least two of the crimping rollers rotatably mounted thereto adjacent the die surface, the crimping rollers being spaced generally uniformly relative to the circumferential dimension of the die surface, such that upon forcible engagement of the dies with the compression sleeve, the crimps formed thereby are generally equally and uniformly spaced about the circumference of the compression sleeve. Each crimping roller is preferably made of hardened steel, and is rotatably mounted on a hardened steel mounting pin.

The shaped dies preferably comprise at least two crimping rollers rotatably mounted adjacent the die surface, one crimping roller being rotably mounted on one axial side of the die surface, and the other of the crimping rollers being rotably mounted on the axially opposite side of the die surface, each crimping roller being positioned at substantially the same radial location relative to the longitudinal axis. The arcuately shaped dies each comprise at least two of the crimping rollers positioned on each axial side of the die surface, each pair of the crimping rollers on each side of the die surface being spaced generally uniformly over the circumferential dimension of the die surface, such that upon forcible engagement of the dies with the compression sleeve, the crimps formed thereby are generally equally and uniformly spaced about the circumference of the compression sleeve. Each arcuately shaped die preferably comprises at least three of the crimping rollers on each axial side of the die surface, each of the three crimping rollers being spaced generally, uniformly over the circumferential dimension of the surface, such that upon forcible generally radial engagement of the dies with the compression sleeve, the crimps formed thereby are generally equally and uniformly spaced about the circumference of the compression sleeve.

In one preferred embodiment the support members each comprise an arm pivotably mounted to a support frame, each arm for supporting at least one of the dies in generally opposed relation to the other die. A third of such dies is fixedly mounted to the support frame at a location and position such that when the arms are moved toward each other at the free ends thereof and the dies are positioned about the compression sleeve, pivotal movement of the arms away from each other at the free ends thereof causes the dies to move inwardly to forcibly contact the sleeve while encompassing at least about two thirds of the circumferential dimension of the sleeve, while the third arcuate jaw encompasses the remaining one third portion of the circumference of the sleeve. Preferably, the third die is formed unitarily with the frame.

In another embodiment, each of the dies is semi-circular in shape and is dimensioned and configured to extend over about one-half the circumference of the sleeve, such that when the arms are positioned with the dies around the compression sleeve and spread apart at the free ends thereof to cause the dies to move into contact with the sleeve, each of the dies attached to the arms encompass at least about one half of the circumferential dimension of the sleeve. In this particular embodiment, each of the dies is preferably formed unitarily with each corresponding arm.

The elastomeric O-ring is preferably made of at least one of synthetic and natural rubber, teflon and compounds thereof. Further, preferably at least two of the crimping rollers are rotatably mounted adjacent each surface, the crimping rollers being spaced uniformly relative to the circumferential dimension of the die surface.

The invention also relates to a method of crimping a generally cylindrical compression sleeve in concentric relation with a pipe or tube to form a compression coupling, comprising positioning a plurality of arcuately shaped dies about the compression sleeve for movement toward and away from the outer surface thereof, each die having an inner arcuate die surface corresponding in shape and dimension to a predetermined outer surface portion of the compression sleeve, the combined circumferential dimension of the die surfaces being sufficient to circumferentially surround the sleeve when the dies are positioned in circumferential engagement therewith. Each die has at least one crimping roller rotatably mounted adjacent said die surface, the crimping roller being positioned and dimensioned to engage and crimp the surface of the compression sleeve when the die surface of the die is positioned in engagement therewith. The method further comprises moving the dies toward the compression sleeve with force sufficient to compress the compression sleeve against the pipe or tube, and to cause the crimping roller to crimp the compression sleeve to the pipe or tube to form the compression coupling. In one embodiment the plurality of arcuately shaped jaws are cormed unitarily with the arms and comprise two dies, each die extending over about one half the outer circumference of the compression sleeve, and each die having at least three crimping rollers rotatably mounted adjacent the die surface. Each die may have at least two crimping rollers rotatably mounted adjacent to the die surface.

The present invention attaches the sleeve to the pipe by positive indentations as compared to the substantially friction-type grip provided in the prior art joints, thus providing an attachment which resists relative rotational slip as well as axial slip between the sleeve and the pipe.

The invention also relates to a die for use in combination with a jaw for crimping a compression sleeve about a pipe or tube, which comprises an arcuately shaped member having a radially inner arcuate die surface corresponding in shape and dimension to a predetermined outer surface portion of the compression sleeve so as to be moved in engagement therewith to apply generally radial compression force thereto. The arcuate member has at least one crimping roller rotatably mounted adjacent said arcuate die surface and dimensioned, configured and adapted to form a crimp on the compression sleeve and the pipe or tube to form a mechanical attachment.

BRIEF DESCRIPTION OF THE DRAWINGS

Preferred embodiments of the invention are described hereinbelow with reference to the drawings, wherein:

FIG. 1 is an elevational view of a pipe (or tube) having a compression sleeve (or fitting) crimped thereto by an apparatus constructed according to the prior art;

FIG. 2 is a cross-sectional view taken along lines 2—2 of FIG. 1;

FIG. 3 is a perspective view of a crimping die constructed according to the present invention, with crimping roller parts separated for convenience of illustration, and illustrating one embodiment having two energy reducing crimping rollers per die;

FIG. 6 is a cross-sectional view taken along lines 6—6 of FIG. 5, showing the crimped sleeve/pipe combination with elastomeric seal after the crimping operation is completed;

FIG. 7 is an elevational view of the tube and sleeve shown in FIGS. 4–6 after the crimping operation has been completed;

FIG. 8 is a cross-sectional view taken along lines 8—8 of FIG. 7;

FIG. 9 is a cross-sectional view of an alternative embodiment of the crimping die of FIG. 3, wherein rollers are positioned on either side of the crimping die for convenience of positioning the crimping jaw with respect to the pipe and sleeve, and also for completing the crimping operation on more than one side of a sleeve to be crimped to a pipe, depending upon the configuration of the sleeve/pipe combination being used at any given time;

FIG. 10 is a plan view of a portion of an alternative embodiment of a crimping jaw incorporating three crimping dies, each having a single energy reducing crimping roller;

FIG. 11 is a plan view of a portion of an alternative embodiment of a crimping jaw of the invention, wherein three crimping dies are incorporated, each crimping die having three energy reducing crimping rollers; and FIG. 12 is a plan view of another alternative embodiment of a crimping jaw constructed according to the invention, incorporating two crimping dies, each die extending over 180 degrees relative to the compression sleeve, and each die having three energy reducing crimping rollers.

DETAILED DESCRIPTION OF THE PREFERRED EMBODIMENTS

Figure 5:
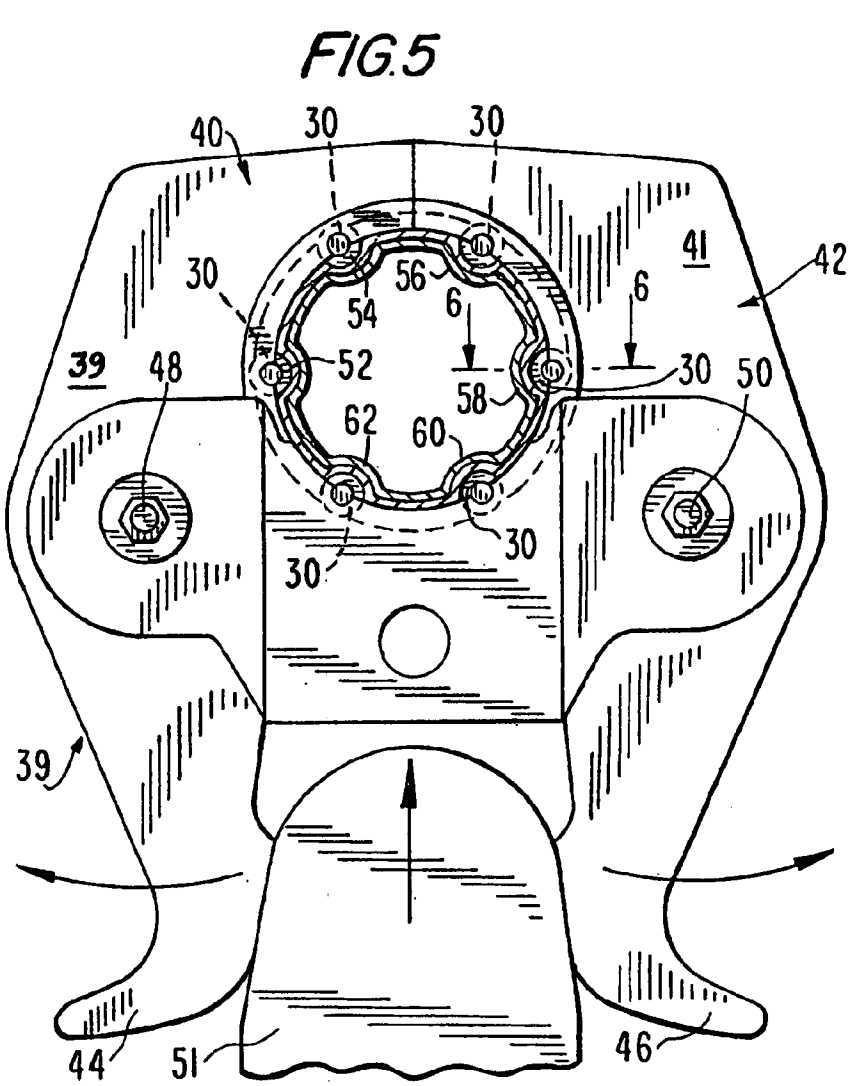
FIG. 5 is a plan view of the crimping tool shown in FIG. 4 after the crimping operation is completed.

The present invention relates to crimping jaws of the type disclosed in U.S. Pat. Nos. 5,611,236 to Grunwald, 5,824,906 to Lohmann, 6,164,106 to Nghlem et al., 6,224,114 to Franzen et al., 6,044,686 to Dischler and 6,260,891 to Foering et al., the disclosures of which are incorporated herein by reference and made a part of this disclosure. Such jaws are configured to crimp a compression sleeve (sometimes referred to as a compression fitting) to a pipe or tube to create a compression coupling having a water tight seal capable of withstanding operating pressures of up to about 300 psi and greater. It is known that such couplings can be subjected to separation forces of up to 4000 pounds or greater, induced by internal pressure.

Referring initially to FIG. 1, there is illustrated a compression sleeve/pipe combination 10 comprised of a pipe 12 having a compression sleeve 14 crimped thereto by a jaw constructed according to the prior art.

The sleeve 14 is tapered at 11 to provide a stop for pipe 12. As noted previously, the prior art jaws generally include a plurality of crimping dies which have a crimping surface—or die surface—which surrounds the crimping flange 17 of the compression sleeve adjacent an O-ring receiving section 16 which encloses an elastomeric O-ring for perfecting a water tight seal between the sleeve and the pipe. When the crimping surface of each die engages the circumferential crimping flange of the sleeve adjacent the raised arcuate concave section of the sleeve which houses the elastomeric O-ring, a substantial amount of energy is expended to crimp and squeeze the dies together. This movement crimps the sleeve and pipe along the entire periphery of the crimping flange 17 to create a mechanical attachment of the sleeve to the pipe while partially squeezing the O-ring section 16 of the sleeve surrounding the O-ring sufficient to compress the O-ring both axially and radially to create a water-tight seal.

According to the prior art procedures, substantial friction forces are developed between the crimping dies and the compression sleeve while the crimping operation takes place completely around the circumference of the sleeve. The formation of a generally continuous circumferential crimp tends to expend significant portions of the available energy. However as noted hereinabove, this procedure also tends to produce discontinuities in the circumferential crimp causing the outer surface material of the sleeve to be pinched and to "bunch up" in locations adjacent to the interfaces between the respective jaws, for example, as shown at 18, 20 and 22 in FIGS. 1 and 2. This effect is due at least in part to the lack of parallelism of the die interfaces. As noted previously, the formation of such "bunched-up" portions is not only unwanted, but also expends available energy unnecessarily. Because of these losses of energy, such crimping jaws have been found to be relatively heavy and inefficient. For example, operating these prior art jaws with battery operated driving tools is also not desirable on a job site due to their excessive weight and excessive drain on available battery power. In such cases pneumatic, hydraulic and electromechanical devices may be needed rather than battery powered devices in order to have the capability to form numerous attachments in sequence, with sufficient power available to complete all attachments. However, such alternative power tools are heavy and not as convenient as battery operable tools, and in any event, the excessive crimping and pinching produces flaws in the attachment which are potential sources of failure. In addition these alternative power tools always require an independent source of power, i.e., compressed air line, electric power source or the like.

Referring now to FIG. 3 there is illustrated a crimping die constructed according to the present invention for incorporation into a "pliers-type" crimping jaw of the types disclosed in U.S. Pat. Nos. 5,611,236 to Grunwald and 6,044,686 to Dischler. The improved die 24 includes a body portion 26 which defines a compression area 28 having a concave, cross-sectional configuration for engagement with the O-ring section of the compression sleeve (not shown in FIG. 3). The O-ring initially has a generally circular cross-sectional configuration and is positioned within an O-ring section which has a raised arcuate concave circumferential section of the sleeve which has a convex outer appearance. The O-ring is an elastomeric ring of a well-known type that is generally formed of an elastomeric material such as synthetic rubber, which is made to be compressed during the crimping operation. Natural rubber, teflon and compounds thereof and the like can also be used. The O-ring is positioned within the O-ring section compression sleeve which is in turn surrounded by a sufficient number of dies which are of appropriate dimension and shape to be moved into snug engagement with the sleeve for the crimping operation.

The die shown in FIG. 3 is constructed according to the present invention. Two energy reducing hardened steel rollers 30 are rotatably mounted on hardened steel shafts 32 for reduction of the energy which is required to engage the compression sleeve about the O-ring and to crimp the sleeve onto the pipe, while compressing the sleeve and thereby, the O-ring, against the surface of the pipe to which the sleeve is being attached. Since the sleeve and the pipe (or tube) is generally made of materials of relatively substantial strength and malleability, such as stainless steel, carbon steel, copper or the like, it will be appreciated that the attaching operation normally requires substantial force to distort the raised arcuate O-ring section of the sleeve which surrounds the O-ring sufficient to compress the sleeve and O-ring in multiple directions, i.e. generally radially, and in certain instances, axially and circumferentially, to a limited extent.

The main distinction in the dies as shown in FIG. 3 as compared to the prior art dies is that crimping is performed only by the rollers 30 to create a mechanical load bearing attachment, while deformation of the remaining peripheral portions of the sleeve complements the crimped attachment and creates the water-tight seal. Thus, whereas with the prior art dies, crimping took place substantially circumferentially around the sleeve, the present dies confine the crimping to spot locations at the roller sites. Since the force multiplied by the distance traveled is a measure of utilized energy, the crimping rollers 30 actually travel a relatively short distance with less force over less area than crimping operations of the prior art. In particular, in comparison to the short distance travelled by each crimping roller during a crimp, i.e., primarily radial and necessarily slightly circumferential due to the rolling motion, the effective circumferential distance which is "traversed" by prior art dies and with greater force, by the entire die surface of prior art dies, the roller dies of the present invention use much less energy to create an improved attachment. Such compression sleeve can also be crimped to plastic tubes and pipes with the present invention.

Figure 4:
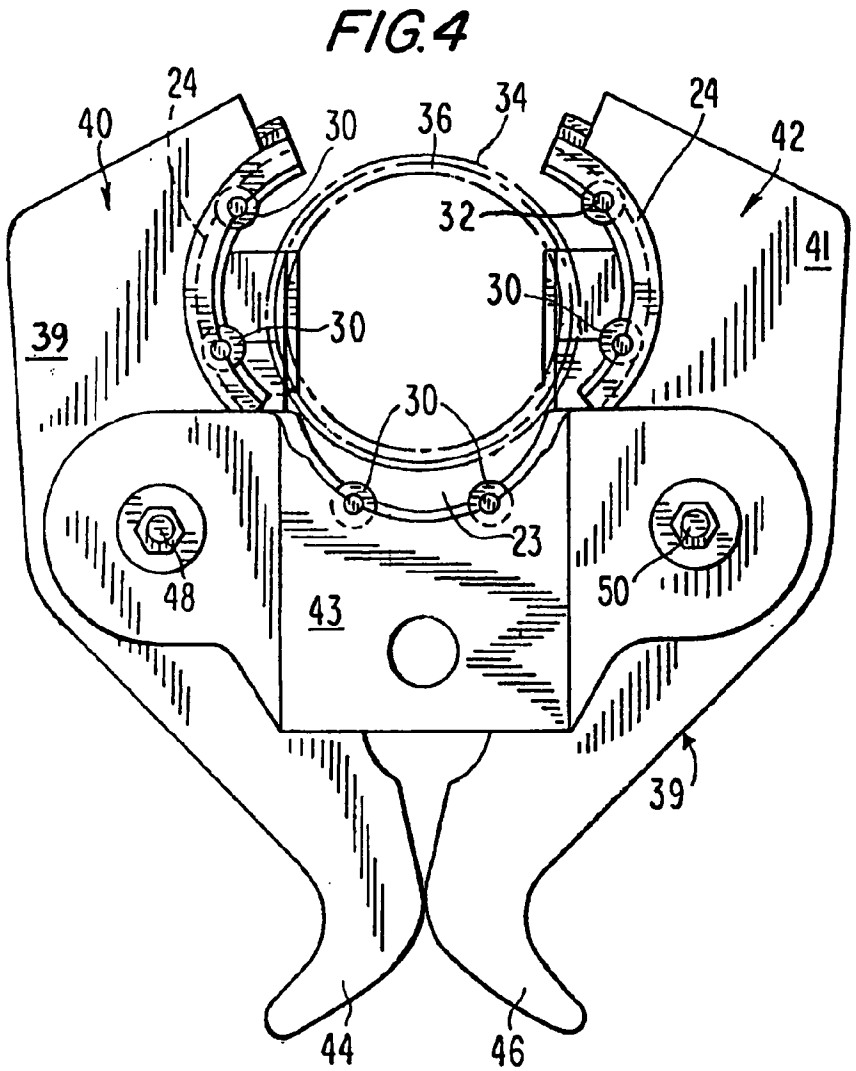
FIG. 4 is a plan view of a crimping tool which incorporates three crimping dies having crimping rollers of the type shown in FIG. 3, the crimping dies being positioned around a sleeve to be crimped to a pipe prior to the crimping operation.

Referring now to FIG. 4 there is shown one type of crimping jaw 39 having arms 40, 42 pivotally attached to horizontal frame 43 as shown. Each arm 40, 42 has removably attached thereto, a die 24 constructed according to the invention as shown in FIG. 3. The jaws are mounted thereon and positioned to form a portion of a circular array around a compression sleeve 34 and pipe 36 to which the sleeve is to be attached. A third die 23 is integrally and unitarily formed as part of the frame 43 to complete the circular array of dies surrounding the sleeve 34 when the jaw is pivoted to the closed position shown in FIG. 5. However, depending upon the particular sleeve/pipe to be crimped, the number of dies to encircle the sleeve and the number of rollers per die can be varied in different combinations.

In this procedure the sleeve is to be crimped as will be described, and an O-ring positioned within the concave O-ring section 34*b* of the sleeve (best shown in FIG. 6) is compressed to perfect a water-tight seal. When the pivotal arms 40, 42 of the crimping jaw are opened by squeezing the lower arm portions 44, 46 together, the upper portions 39, 41 of arms 40, 42 are made to pivot about pivot pins 48, 50 to open the jaws sufficient to receive the sleeve and the pipe 36. Once the crimping jaw is positioned around the sleeve 34 and the pipe 36, a power spreading tool 51 of a known type, shown schematically in FIG. 5, is inserted between the lower arm portions 44, 46 of the crimping tool 39 to cause the upper ends 39, 41 of arms 40, 42 to pivot toward the "closed dies" position to complete the crimping operation of the sleeve to the pipe 36, and to compress the O-ring section 34*b* and O-ring 64 against the outer surface of the tube 36. The actual crimping operation and the resultant configuration of the sleeve and O-ring positioned within the concave O-ring section 34*b* of the sleeve 34 is shown in the cross-sectional view in FIG. 6. The power spreading tool 51 can be manually operated or power driven by electric or battery power sources, and in such cases the power devices will be less costly and smaller and lighter in weight. Also, the arms 40, 42 can be made lighter in weight since less force is required for crimping. As noted previously the jaw can also be spread by hydraulic, pneumatic and electromechanical devices. In addition, alternative power devices for operating the jaw are contemplated for use with the present unique dies, such as the compression tool for compression molding die disclosed in U.S. Pat. No. 6,044,086 to Dischler.

It will be appreciated that the hardened steel rollers 30 shown in FIGS. 3, 4 and 5 significantly reduce the energy required to crimp the compression sleeve about the pipe by concentrating the crimping force for several reasons. For the first reason it is believed that the rollers provide very slight rolling motion and thereby reduce the friction which is generally generated between the dies of the crimping jaw 39 and the sleeve as the dies pivot inwardly toward the sleeve. The second reason is believed to be due to the concentration of the crimping force which is taking place beneath each roller 30 over a smaller area of the sleeve and pipe to which the sleeve is being attached, to cause a plurality of crimped indentations located and equally spaced beneath each roller around the cross-section of the assembled device. Each indentation corresponds to a location of a roller 30. For example, the cross-sectional view of the crimped sleeve and pipe shown in FIG. 5 includes six indentations 52, 54, 56, 58, 60 and 62, spaced equally and uniformly about the circumference of the crimped sleeve, with each crimp corresponding to a corresponding position of a roller 30.

FIG. 6 is a cross-sectional view of the completed crimp wherein each roller 30 creates a small amount of crimp on both the compression sleeve 34 and the pipe 36, while at the same time compressing the O-ring 64 to create a water-tight seal between the pipe and the sleeve. As noted previously, the O-ring 64 was originally circular in cross-section, but after radial compression of the O-ring section 34*b*, the O-ring assumes a somewhat generally triangular cross-sectional shape which corresponds to the cross-section of the compressed O-ring Section 34*b*, as shown in FIG. 6. In FIG. 6, the hardened steel roller 30 is shown engaging the outer surface of the sleeve 34 and producing a crimp 66, which alters the shape of the layers of crimping flange 34*a* of sleeve 34 and pipe 36 as shown, such that the appearance of each crimp 66 is as shown in FIG. 7.

FIG. 8 is a cross-sectional view taken along lines 8—8 of FIG. 7, of the crimped portions 66 of sleeve 34 and pipe 36 to which it is attached. As can be seen in FIG. 8, the uniform spacing and degree of indentation of each of the crimps 66 corresponds generally to the uniform and equal spacing and dimensions of steel rollers 30 as positioned on the crimping dies 24.

Referring now to FIG. 9 there is illustrated an alternative embodiment of the invention wherein like components are numbered similarly to the previous embodiments, but with the addition of "100" to each reference numeral.

In comparison to the sleeves shown in FIGS. 1 and 7, the sleeve shown in FIG. 9 is an example of an alternative sleeve which is not provided with a pipe stop taper at 131 in order to receive a pipe into each end (right side not shown) for repair of a leak in a pipe. However, the present invention is intended for use with all such types of sleeves. In FIG. 9 a crimping die 124 is provided with the same concave O-ring compressing section 128 as is shown in FIG. 3 for compressing the O-ring section 134 and O-ring 164 against the pipe 136. However, in this embodiment, dual sets of hardened steel rollers 130 are provided with one roller located on each side of the concave compressing section 128, such that the crimping operation can be performed on a sleeve/pipe combination from either direction. Another advantage of the embodiment of FIG. 9 is that crimping can be performed on a compression sleeve 134 having a crimping flange 134*a* on either side of the concave O-ring receiving section 134*b* of the sleeve. The sleeve shown in FIG. 9 is of the "Single Flange" type generally contemplated for use with the "Single Crimp"-type die 24 shown in FIG. 3. However when a dual crimping die as shown in FIG. 9 is used on a "Dual Crimp"-type sleeve, the crimping jaw is positioned about the sleeve and the sleeve has a crimping flange 134*a* on both the left side of the O-ring (not shown in FIG. 9), as well as on the right side of the O-ring receiving section 134*b*.

As noted previously, there are instances as shown in FIG. 9, where a dual crimp jaw may be utilized to crimp a single crimp sleeve. In such instance, the dual crimp jaw can be positioned about the sleeve/pipe combination from either of two directions, providing an advantage to the user which may be required due to space considerations on a particular job site. It can be seen that where multiple single crimps are to be performed on a relatively long length of pipe, the user can perform each crimp in succession until the penultimate crimp, whereby the jaw can then be positioned from the direction which is most convenient to perform the last crimp, given space considerations on the particular job site.

It has been found that for sleeve/pipe crimping operations utilizing pipes of 1½ inch or less, the crimping jaw shown in FIG. 9 can be utilized for crimping a single crimp sleeve, since the crimping force is not as aggressive in the 1½ inch size jaw as in the 2 inch jaw, i.e, the indentation (if any) created by each roller on the portion of pipe opposite the crimp is negligible. However, for single crimp sleeves and pipes of 2 inch diameter or greater the crimping force is substantially greater and therefore the dual rollers as shown in FIG. 9 are not recommended for this size coupling since the non-working roller may actually score or crimp the pipe on the side which is not intended for crimping, thereby consuming energy otherwise intended for crimping, and causing a potential failure in the pipe.

Another advantage of the dual roller embodiment shown in FIG. 9 is for applications where numerous crimps are to be made along substantial lengths of pipe. In such cases, the crimps can be either single or dual. As noted, when a crimp is to be performed on a sleeve positioned about an end portion of a pipe, the dual roller embodiment provides an advantage in that positioning the jaw over the sleeve can be accomplished from either direction, whichever is most convenient, dependent on space and environmental considerations.

It will be appreciated that the jaw of the present invention provides a superior attachment in comparison to the prior art jaws. In particular, whereas the prior art jaws caused a crimp of substantial depth generally circumferentially of the compression sleeve, the jaws of the present invention actually create a localized mechanical indentation in each location corresponding to a roller, which is distinguishable from the more "circumferential" crimp created by the prior art jaws. With the jaws of the present invention, the circumferential portion of the sleeve between rollers is not crimped, but rather is made to touch with limited force, the outer surface of the pipe while compressing the O-ring sufficient to create a watertight seal, with significantly less energy expended.

The jaw of the present invention provides a plurality of spaced mechanical attachments in the form of each roller created indentation, utilizing less energy than jaws of the prior art.

Failure tests of crimped sleeve/pipe couplings of the prior art have been compared to failure tests of assemblies made with jaws constructed according to the present invention by submitting them to excessive water pressure i.e., up to about 900 psi. In the prior art crimps, the tube and the sleeve separated axially, expanding the crimp in the sleeve radially outward. In assemblies made by jaws of the present invention, the indentations made by each roller was found to be substantially stronger due in part to the fact that each roller created indentation has about four substantially distinct sides, 66*a*, 66*b*, 66*c* and 66*d* as shown in FIG. 7. When failure occurred, each crimp in pipe 36 became distorted and appeared to be elongated in the axial direction, thus exhibiting a different failure mode.

FIG. 10 is an alternative embodiment of the invention showing a crimping jaw having three equally dimensioned dies 224, with each die having a single roller 230 as shown.

FIG. 11 is a plan view of still another alternative embodiment of a portion of a crimping jaw having three equally spaced dies 324, with each die having three energy-reducing crimping rollers 330 as shown.

FIG. 12 is a plan view of a crimping jaw having a pair of crimping dies 424 in an embodiment wherein only two dies are made to form a circular configuration, with each die having three energy-reducing rollers 430 as shown and being formed integral and unitarily with the pivoting arms.

It will be appreciated that the energy-reducing dies constructed according to the present invention clearly provide an improved coupling with a reduction of energy required to crimp a sleeve/O-ring combination to a pipe or tube to provide a water tight seal. The reduction in energy utilized to produce the improved coupling is due at least in part to the reduction of the interactive friction forces between the crimping portion of the die and the sleeve. More specifically, the reduction of the interactive friction forces in such tool is provided by several factors which may be summarized as follows:

1. As the die is moved to the closed position about the sleeve, the rollers translate somewhat circumferentially and radially over the surface of the sleeve while rolling over that surface. At the same time the rollers are creating the crimp- or indentation- in the sleeve and the pipe. The rolling action of the rollers doesn't resist the crimping jaws in moving in their somewhat circumferential and radial directions, via reduced friction. It is believed that the rolling action of the rollers actually reduces the interactive friction between the crimping die and the sleeve, while simultaneously forming an indentation in the sleeve and the inner pipe, as well as compressing the sleeve circumferentially and axially around the pipe to create the sealed attachment.

2. The attachment operation is heavily concentrated in the areas of each roller, with sufficient compression of the sleeve taking place between the die surface of the crimping dies and the sleeve, to compress the elastomeric O-ring against the pipe. Therefore the area of each indentation created by the rollers is substantially less than that of the crimps of the prior art dies so as to permit the attachment operation of each die to generate less friction and to provide systematic and uniform movement of the dies during the closing motion of the jaw.

The reduction of energy required to attach the sleeve and O-ring combination to the pipe permits the end user to be able to utilize battery-operated tools which are generally lower in available energy. On-site battery operated tools are smaller in size, lighter in weight and therefore less fatiguing to use. These advantages will be readily appreciated when multiple crimping operations are to be performed.

It will be appreciated that although the dies of the present invention have been shown and described for use with a plier-type application device, it will become readily apparent to persons skilled in the art that any type of crimping device can be used with the dies of the present invention. For example, alternative types of devices for squeezing the dies around a workpiece which are not necessarily of the pliers-type are also contemplated.

The invention claimed is:

1. A jaw for crimping a generally cylindrical compression sleeve in a compression coupling, which comprises at least two support members adapted to support at least two arcuately shaped dies for movement toward and away from each other for compressing the compression sleeve about an inner member to form a sealed coupling therewith, each said die having an inner arcuate die surface corresponding generally in circumferential shape and dimension to a predetermined outer surface portion of the compression sleeve, said die surface including a section having a generally concave cross-section so as to engage and compress the compression sleeve when positioned thereabout and moved toward each other, said dies each having at least one crimping roller rotatably mounted adjacent said die surface, said crimping roller adapted to form a crimp on the compression sleeve and the inner member to form a mechanical attachment.

2. The jaw according to claim 1, wherein the radially innermost dimension of said crimping roller as measured relative to a central longitudinal axis of the compression sleeve is less than the corresponding radius of said die surface such that when said dies are positioned about the compression sleeve and forcibly moved toward each other to engage and compress the compression sleeve, said rollers engage and crimp portions of the compression sleeve to form said mechanical attachment.

3. The jaw according to claim 2, wherein the compression sleeve has a generally tubular configuration and includes a section having an arcuate concave cross-section for reception of an elastomeric O-ring therewithin, each said arcuately shaped die surface of said dies corresponding in dimension and shape to be positioned about the compression sleeve for applying compression thereto and to the O-ring to form a sealed attachment.

4. The jaw according to claim 3, wherein each said die has at least two of said crimping rollers rotatably mounted thereto adjacent said die surface, said crimping rollers being spaced generally uniformly relative to the circumferential dimension of said die surface, such that upon forcible engagement of said dies with said compression sleeve, said crimps formed thereby are generally equally and uniformly spaced about the circumference of the compression sleeve.

5. The jaw according to claim 4, wherein each said crimping rollers is made of hardened steel.

6. The jaw according to claim 5, wherein each said crimping rollers is rotatably mounted on a hardened steel mounting pin.

7. The jaw according to claim 6, wherein each said arcuately shaped dies comprises at least two crimping rollers rotatably mounted adjacent said die surface, one crimping roller being mounted on one axial side of said die surface, and the other of said crimping rollers being mounted on the axially opposite side of said die surface, each said crimping rollers being positioned at substantially the same radial location relative to said longitudinal axis.

8. The jaw according to claim 7, wherein each said arcuately shaped dies comprises at least two of said crimping rollers positioned on each axial side of said die surface, each pair of said crimping rollers on each side of said die surface being spaced uniformly over the circumferential dimension of said die surface, such that upon forcible engagement of said dies with said compression sleeve, said crimps formed thereby are generally equally and uniformly spaced about the circumference of the compression sleeve.

9. The jaw according to claim 8, wherein each said arcuately shaped dies has a semi-circular shape such that two of said dies completely surround the compression sleeve when moved to the said positions in engagement with the sleeve.

10. The jaw according to claim 9, wherein each said arcuately shaped dies comprises at least three of said crimping rollers on each axial side of said die surface, each of said three crimping rollers being spaced uniformly over the circumferential dimension of said surface, such that upon forcible generally radial engagement of said dies with said compression sleeve, said crimps formed thereby are generally equally and uniformly spaced about the circumference of the compression sleeve.

11. The jaw according to claim 8, wherein each said support members comprises an arm pivotably mounted to a support frame, each said arm for supporting at least one of said dies in generally opposed relation to said other die, and a third of such dies being fixedly mounted to said support frame at a location and position such that when said arms are moved toward each other at the free ends thereof and said dies are positioned about the compression sleeve, pivotal movement of said arms away from each other at the free ends thereof causes said jaws to move inwardly to forcibly contact the sleeve while encompassing at least about two thirds of the circumferential dimension of the sleeve, while said third arcuate jaw encompasses the remaining one third portion of the circumference of the sleeve.

12. The jaw according to claim 11, wherein said third die is formed unitarily with said frame.

13. The jaw according to claim 10, wherein each said support members comprises an arm pivotably mounted to a support frame, each said arm for supporting at least one of said dies in generally opposed relation to each other, each said dies dimensioned and configured to extend over about one-half the circumference of the sleeve, such that when said arms are positioned with said dies around the compression sleeve and spread apart at the free ends thereof to cause said dies to move into contact with the sleeve, each said dies attached to said arms encompass at least about one half of the circumferential dimension of the sleeve.

14. The jaw according to claim 13, wherein each said die is formed integral and unitarily with each said corresponding arm.

15. A jaw for crimping at least two generally cylindrical concentrically positioned workpieces so as to form an attachment thereof, which comprises a device for supporting at least two arcuately shaped dies arranged in a generally circular array and adapted for movement of said dies toward and away from each other for compressing the outer workpiece against the inner workpiece, each said die having an inner arcuate die surface corresponding generally in circumferential shape and dimension to at least a portion of the outer workpiece, said die surface including a section having a generally arcuate concave cross-section so as to engage and compress the outer workpiece when positioned thereabout and moved toward each other, each said die each having at least one crimping roller rotatably mounted adjacent said die surface, said crimping roller adapted to form a crimp on the outer and inner workpieces to form a mechanical attachment thereof.

16. A jaw for crimping at least two generally cylindrical concentrically positioned workpieces so as to form a mechanical attachment thereof, which comprises a device for supporting a plurality of arcuately shaped dies, said device being adapted to separate said jaws generally away from each other to permit positioning of the workpieces therebetween, said device further being adapted to forcibly move said dies generally toward each other and the workpieces, to apply generally inward forces to the workpieces, each said die having at least one inner arcuate die surface corresponding generally in dimension and shape to at least a preselected portion of the outer surface of the outer workpiece, said die surface including at least a section having a generally arcuate concave cross-section and at least one crimping roller mounted for rotation adjacent said die surface for engaging and crimping the workpieces to crimp the workpieces to form a mechanical attachment thereof.

17. A jaw for crimping a compression sleeve in a compression coupling, which comprises at least two support members adapted to support at least two arcuately shaped dies in generally spaced relation for movement generally toward and away from each other for compressing the compression sleeve about an inner member to form a sealed coupling therewith, a portion of the compression sleeve having a seal ring section having a concave generally arcuate cross-sectional configuration for reception of an elastomeric sealing O-ring, each said die having an inner arcuate die surface corresponding in shape and dimension to a preselected outer surface portion of said arcuate seal ring section so as to engage and compress the compression sleeve when positioned thereabout and moved by said support members toward the sleeve, said dies each having at least one crimping roller rotatably mounted adjacent said die surface, said crimping roller adapted to form a crimp on the compression sleeve and the inner member to form a mechanical attachment therebetween.

18. The jaw according to claim 17, wherein the inner member is a pipe or tube intended for attachment to the compression sleeve.

19. The jaw according to claim 18, wherein the elastomeric O-ring is made of at least one of synthetic and natural rubber, teflon and compounds thereof.

20. The jaw according to claim 17, wherein each support member has at least two of said crimping rollers rotatably mounted thereto adjacent said die surface, said crimping rollers being spaced uniformly relative to the circumferential dimension of said die surface.

21. The jaw according to claim 20, wherein each said crimping rollers is made of hardened steel.

22. The jaw according to claim 21, wherein each said crimping rollers is rotatably mounted on a hardened steel mounting pin.

23. The jaw according to claim 22, wherein each said arcuately shaped dies comprises at least two crimping rollers rotatably mounted adjacent said die surface, one crimping roller being mounted on one side of said die surface, and the other of said crimping rollers being mounted on the axially opposite side of said die surface, each said crimping rollers being positioned at substantially the same radial location relative to said longitudinal axis.

24. The jaw according claim 23, wherein each said arcuately shaped dies comprise at least two of said crimping rollers positioned on each axial side of said die surface, each pair of said crimping rollers on each side of said die surface being spaced uniformly over the circumferential dimension of said die surface, such that upon forcible engagement of said dies with the compression sleeve, said crimps formed thereby are generally equally and uniformly spaced about the circumference of the compression sleeve.

25. The jaw according to claim 24, wherein each said arcuately shaped dies has a semi-circular shape such that two of said jaws completely surround the compression sleeve when moved to the engaged positions.

26. The jaw according to claim 25, wherein each said arcuately shaped dies comprises at least three of said crimping rollers on each axial side of said die surface, each of said three crimping rollers being spaced uniformly over the circumferential dimension of said die surface, such that upon forcible engagement of said dies with the compression sleeve, said crimps formed thereby are generally equally and uniformly spaced about the circumference of the compression sleeve.

27. A method of crimping a generally cylindrical compression sleeve in concentric relation with a pipe or tube to form a compression coupling, comprising:

a) positioning a plurality of arcuately shaped dies about the compression sleeve for movement toward and away from the outer surface thereof, each said die having an inner arcuate die surface corresponding in shape and dimension to a predetermined outer surface portion of the compression sleeve, the combined circumferential dimension of said die surfaces being sufficient to circumferentially surround the sleeve when said dies are positioned in circumferential engagement therewith, each said die having at least one crimping roller rotatably mounted adjacent said die surface, said crimping roller being positioned and dimensioned to engage and crimp the surface of the compression sleeve when said die surface of said die is positioned in engagement therewith; and b) moving said dies toward the compression sleeve with force sufficient to compress the compression sleeve-against the pipe or tube, and to cause said crimping roller to crimp the compression sleeve to the pipe or tube to form the compression coupling.

28. The method according to claim 27, wherein said plurality of arcuately shaped jaws comprises two dies, each die extending over about one half the outer circumference of the compression sleeve.

29. The method according to claim 28, wherein each said dies has at least two crimping rollers rotatably mounted adjacent said die surface.

30. The method according to claim 29, wherein each said dies has at least three crimping rollers rotatably mounted adjacent to said die surface.

31. A die for use in combination with a jaw for crimping a compression sleeve about a pipe or tube, which comprises an arcuately shaped member having a radially inner arcuate die surface corresponding generally in circumferential shape and dimension to a predetermined outer surface portion of the compression sleeve, said die surface including a section having a generally arcuate concave cross-section so as to be moved in engagement with the compression sleeve to apply generally radial compression force thereto, said arcuate member having at least one crimping roller rotatably mounted adjacent said arcuate die surface and dimensioned, configured and adapted to form a crimp on the compression sleeve and the pipe or tube to form a mechanical attachment.

32. The die according to claim 31, wherein said arcuate member is made of hardened die material.

33. The die according to claim 32, wherein said hardened die material is hardened steel.

34. The die according to claim 33, wherein said crimping roller is made of hardened die material.

35. The die according to claim 34, wherein said hardened die material of said crimping roller is hardened steel.

36. The die according to claim 35, wherein said crimping roller is rotatably mounted on a hardened steel pin.

37. The die according to claim 36, wherein said arcuate member is generally circular and extends over a circumferential arc of about 90 degrees or greater.

38. The die according to claim 37, wherein said arcuate member is generally circular and extends over a circumferential arc of about 180 degrees.

39. The die according to claim 38, wherein said arcuate member includes at least two of said crimping rollers rotatably mounted thereto adjacent said die surface.

40. The die according to claim 39, wherein said arcuate member includes at least three of said crimping rollers rotatably mounted thereto adjacent said die surface.

* * * * *